United States Patent [19]

Brembilla et al.

[11] Patent Number: 4,493,160

[45] Date of Patent: Jan. 15, 1985

[54] AUTOMATIC STEAM BOX FOR TEXTILE ARTICLES

[76] Inventors: Almiro Brembilla; Sergio C. Pisani, both of Via Morosini, 16, 27029, Vigevano (Pavia), Italy

[21] Appl. No.: 516,719

[22] Filed: Jul. 25, 1983

[30] Foreign Application Priority Data

Aug. 2, 1982 [IT] Italy ..... 22693 A/82

[51] Int. Cl.[3] ..... D06F 71/16

[52] U.S. Cl. ..... 38/14; 38/1 A; 38/1 D

[58] Field of Search ..... 38/14, 1 A, 1 D; 223/52, 11

[56] References Cited

U.S. PATENT DOCUMENTS 2,357,392 9/1944 Francis, Jr. ..... 223/52 X 2,606,272 8/1952 Platt ..... 38/14

2,911,729 11/1959 Wood ..... 223/52

3,414,174 12/1968 Off ..... 223/52

FOREIGN PATENT DOCUMENTS 2817351 10/1979 Fed. Rep. of Germany ..... 38/14

*Primary Examiner*—Werner H. Schroeder

*Assistant Examiner*—Andrew M. Falik

*Attorney, Agent, or Firm*—Bucknam and Archer

[57] ABSTRACT

An apparatus for automatically ironing textile articles and the like comprises a box-like structure provided with bellows doors, which are mechanically driven to open and closed positions. In the central portion of the bellows doors, an upright is pivoted which is also mechanically driven for alternately rotating through a 180° angle, and bearing two radially extending arms provided for supporting the textile articles to be ironed.

4 Claims, 5 Drawing Figures

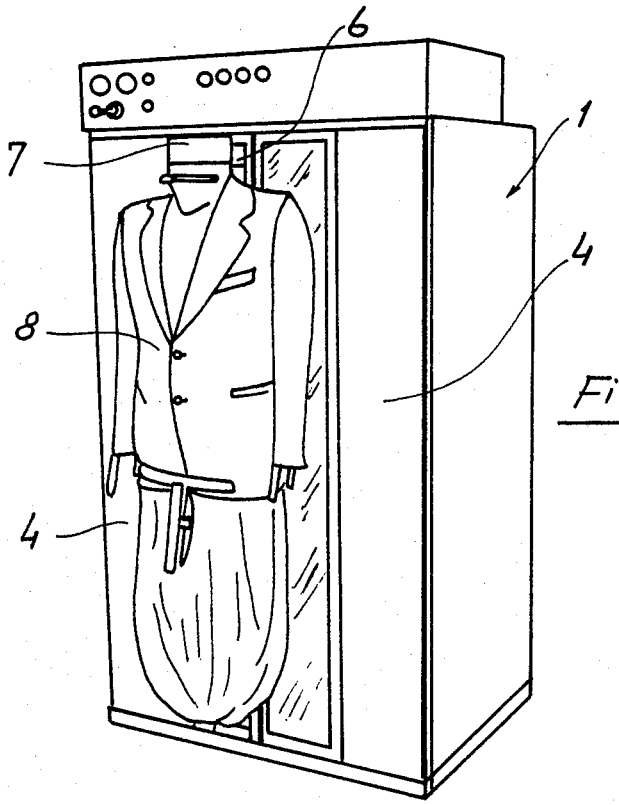
Fig. 3
Fig. 4
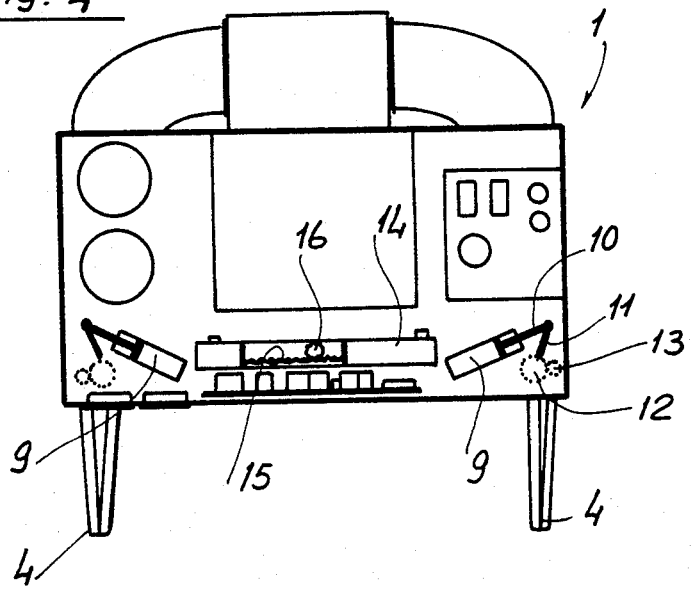

AUTOMATIC STEAM BOX FOR TEXTILE ARTICLES

BACKGROUND OF THE INVENTION

The present invention relates to an apparatus for automatically ironing textile articles and the like.

It is known, that garment articles are usually ironed by heating them in a moist environment and under a given pressure.

For carrying out this operation, structures are presently available, of box shape, in which the garment article, suitably fitted to manikins, or arranged between clamps and the like, is subjected to impinging hot steam.

In the known box-like structures, however, the blowing through of hot steam and subsequent ironing operations (such as circulating of air in the interior, drying ventilating and so on) are individually carried out, through manual controls.

This fact, in addition to fatigueing the operator, causes the the several ironing steps to be subjectively controlled by the operator, so that the garments are not uniformly and perfectly ironed.

Moreover, in conventional box-like ironing apparatus, the door closing and opening operations, in order to insulate the garment during the ironing step, are presently carried out manually; thus one may have a door which is not perfectly closed so that hot steam may escape through the door and impinge on the operator.

SUMMARY OF THE INVENTION

Accordingly, the object of the present invention is to overcome the above mentioned drawbacks, by providing such an apparatus for ironing textile articles, in which the several ironing steps may be preliminarily adjusted, in strength and duration.

It is a main object of the present invention to provide such an apparatus for ironing textile articles or garments, in which the doors may be closed and opened in an automatic mechanical way, while assuring a perfect closure tightness.

Another object of the present invention is to provide such an apparatus for ironing textile articles or garments, in which the upright supporting the garment bearing members may be rotated automatically at the beginning of the ironing cycle.

According to one aspect of the present invention, the above objects, as well as yet other objects which will become more apparent hereinbelow, are achieved by an apparatus for automatically ironing textile articles or garments, which comprises a box-like structure, including bellows doors which are mechanically driven to opening and closing positions, and an upright, also mechanically driven, in such a way as to rotate alternately through a 180° angle, and bearing two radially extending arms capable of supporting the textile article bearing members, as well as conventional steam generators, fans, exhausters, ducts for properly carrying out the ironing cycle. The ironing cycle is controlled by a plurality of timers, capable of setting the duration of the steam blowing in period, the rest period before shutting off the ventilation, the ventilation shut off period, and the hot air exhausting period. The upright, upon rotating, is capable of closing the bellows doors, so as to start an ironing cycle, the doors being adapted to being opened at the end of the ironing cycle.

BRIEF DESCRIPTION OF THE DRAWINGS

Further characteristics and advantages of the apparatus for automatically ironing textile articles or garments, according to the present invention, will become more apparent hereinbelow from the following detailed description of a preferred embodiment, being illustrated, by way of an indicative example, in the accompanying drawings, where:

FIG. 3 illustrates that same ironing apparatus with its bellows doors in a closed condition;

FIG. 4 is a schematic top view illustrating the ironing apparatus according to the present invention.

DESCRIPTION OF A PREFERRED EMBODIMENT

Figure 2:
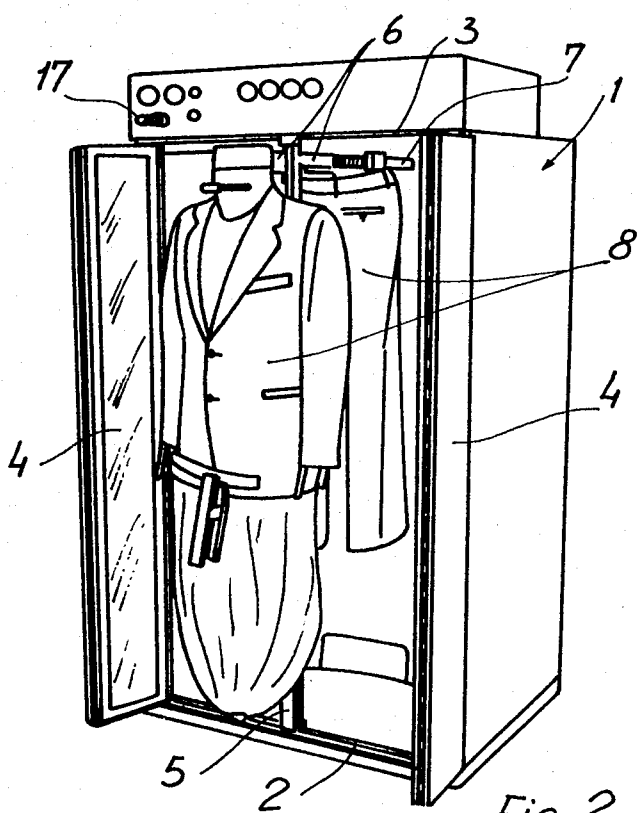
FIG. 2 illustrates that same ironing apparatus, with its doors in an open condition, after the rotation of the textile article bearing member supporting upright.

With reference to the figures of the accompanying drawings, the apparatus for automatically ironing textile articles and the like according to the present invention comprises a box-like structure 1, of suitable size, provided with lower and upper sliding guides, indicated at 2 and 3 respectively, along which two bellows doors may be displaced, indicated at 4, the abutment portions of which being provided with suitable sealing material.

In the central portion of the above mentioned guides there is pivoted an upright 5, having a square or polygonal cross-section, which is adapted to provide tightness of the above mentioned sealing material or gaskets.

More specifically the upright bears, at its top, two opposite radially extending arms 6, to which suitable means are affixed, indicated at 7, which are adapted to support cloth articles 8.

In particular, the bellows doors are driven by corresponding double action cylinders 9 the stem 10 of which is coupled to a rod 11, rigid with a gear wheel and radially extending with respect to it, the gear wheel being indicated at 12 and meshing with a sprocket 13 capable of causing the doors to rotate and slide.

On the other hand, the upright 5 is driven by a rack 15, sliding in a double action cylinder 14 and meshing with a sprocket 16, keyed at the top of the upright.

Figure 1:
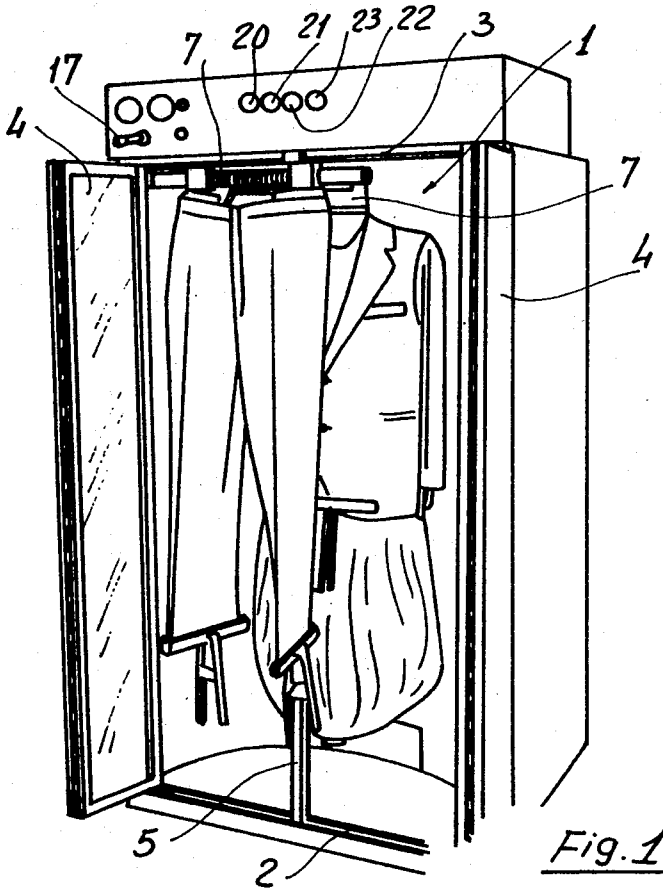
FIG. 1 is a perspective view illustrating the ironing apparatus with its doors in the open condition.
Figure 5:
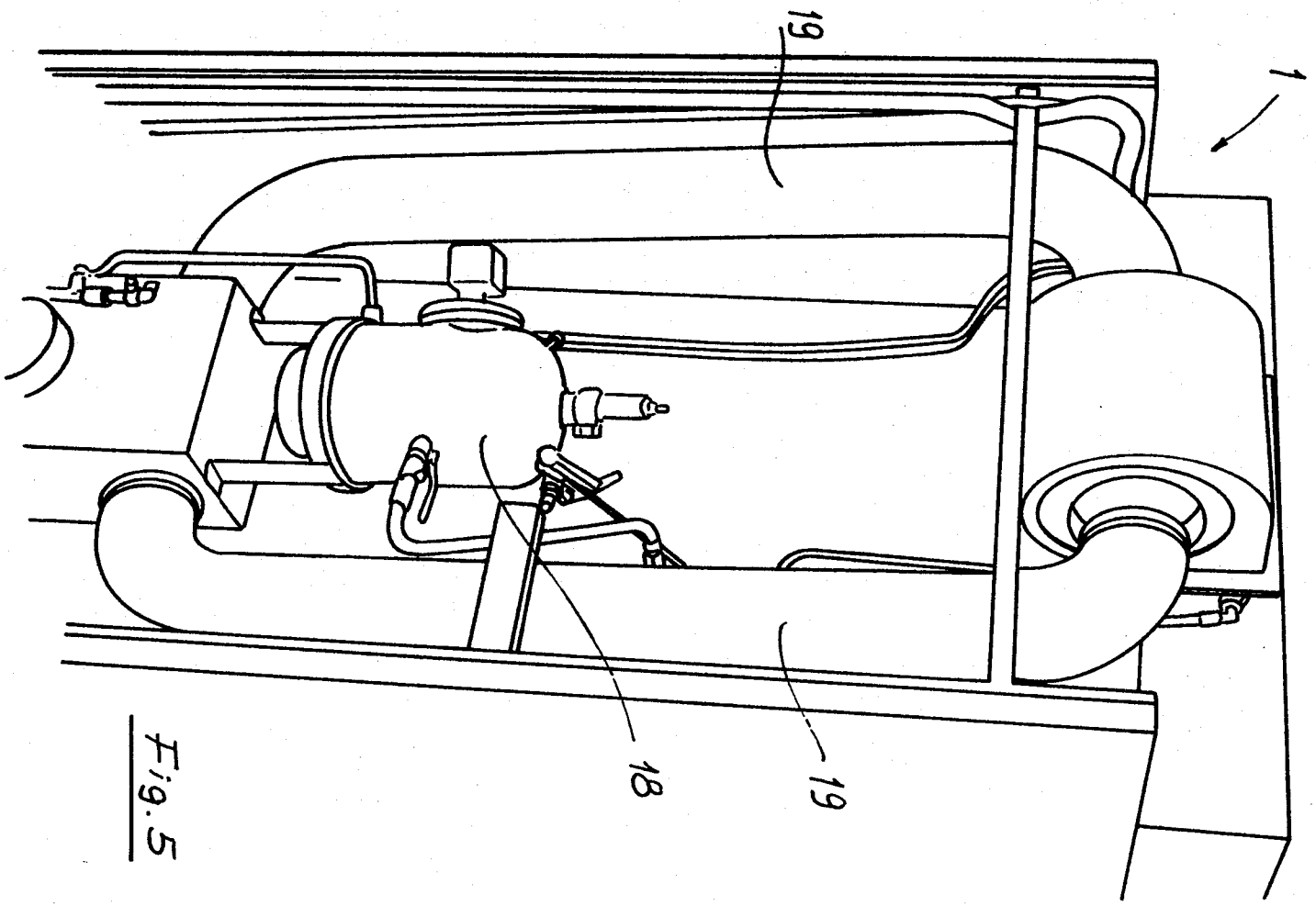
FIG. 5 is a rear perspective view of that same ironing apparatus.

In actual practice, by operating one of the push-buttons 17, the upright is caused to rotate through 180°, so that the cloth article supported on the outer arm is brought inside the box-structure, while a cloth article is ironed outside (see FIGS. 1 and 2).

Then the bellows doors are closed and hot steam, which is supplied by the steam generator 18, is blown within the box structure for a given period of time.

An adjustable rest period follows at the end of which hot air is circulated in a closed loop fashion through the ducts 19, to convert steam into hot air.

Then the cloth article drying step is started by means of forced ventilation and exhaustion, the outgoing inner hot air being replaced by environment temperature air.

At the end of this step the bellows doors are automatically opened, the several steps of the operating cycle being completed.

By operating one of the above mentioned push-buttons 17 a new operative cycle is started, in which the upright 5 is rotated and the bellows doors closed, in such a way as to afford the operator the possibility of removing the ironed cloth article, which is carried by the outer arm, to be replaced by a new cloth article to be ironed.

The time period between the beginning and the the end of the mentioned steps may be adjusted by means of timers 20,21,22 and 23 provided for controlling the steam blow-in time, rest time and closed loop air circulation and exhausting times.

From the above disclosure and from the figures of the accompanying drawings the functionality and use facility characterizing the apparatus for automatically ironing cloth articles and the like according to the present invention will be self-evident.

While a preferred embodiment of the subject ironing apparatus has been disclosed and illustrated, it should be pointed out that this embodiment is susceptible to many modifications and variations all of which fall within the scope of the invention as it is defined in the accompanying claims.

We claim:

1. An apparatus for automatically carrying out the ironing cycle of a textile article or the like which ironing cycle comprises the steps of blowing hot steam through said article, providing for a rest period, ironing said article, circulating hot air through said article, drying said article by ventilation and exhausting the hot air, which apparatus comprises a box-like structure (1), a steam generator (18), a fan for providing ventilation, an exhauster for exhausting the hot air, said box-like structure including two bellows doors (4) mechanically driven to opening and closing positions, an upright (5), mechanically driven and rotatable alternately through a 180° angle, said upright bearing two radially extending arms (6) which are adapted to support said textile article, a plurality of timers (20, 21, 22, 23) for controlling said ironing cycle, said timers being capable of setting the duration of the step of blowing in steam, controlling the rest period, the ventilation step, the hot air exhausting period, said upright (5), upon rotation, being capable of closing said bellows doors (4), to start the ironing cycle, said article being located within said box-like structure supported by one of said radially extending arms, said doors being capable of opening at the end of said ironing cycle.

2. An ironing apparatus according to claim 1 wherein said box-like structure is provided with lower and upper guides (2 and 3), said two bellows doors (4) being slidable along said guides, the abutment portions thereof are provided with sealing gaskets, said upright (5) being pivoted at the central portion of said guides (2 and 3).

3. An ironing apparatus according to claim 1 which comprises double action cylinders (9) for driving said two bellows doors (4), the stem (11) of each said cylinder being pivoted to a rod (11) rigid with a gear wheel (12) and radially extending with respect to the latter, said gear wheel (12) meshing with a sprocket (13) adapted for causing said bellows doors (4) to rotate and slide.

4. An ironing apparatus, according to claim 1 which comprises a rack (15), slidingly housed in a double action cylinder (14), said rack (15) meshing with a sprocket (16) keyed at the top of said upright (5), for causing said upright (5) to rotate.

* * * * *